US005753052A

United States Patent [19]

Dajoux et al.

[11] Patent Number: 5,753,052

[45] Date of Patent: May 19, 1998

[54] METHOD OF TREATING FERROUS SURFACES SUBJECTED TO HIGH FRICTION STRAINS

[75] Inventors: Bernard Dajoux, Bonson; Antoine Martin, Sury le Comtal, both of France

[73] Assignee: Centre Stephanois de Recherches Mecaniques Hydromecanique et Frottement, Andrezieux-Boutheon, France

[21] Appl. No.: 607,491

[22] Filed: Feb. 27, 1996

[30] Foreign Application Priority Data

Mar. 1, 1995 [FR] France ..... 95 02373

[51] Int. Cl.[6] ..... C23C 8/20

[52] U.S. Cl. ..... 148/217; 148/234; 148/242

[58] Field of Search ..... 148/217, 242, 148/220, 234, 235

[56] References Cited

U.S. PATENT DOCUMENTS

| | | | |
|---|---|---|---|
| 3,912,547 | 10/1975 | Gaucher | 148/217 |
| 4,006,043 | 2/1977 | Gaucher | 148/217 |
| 5,102,476 | 4/1992 | Wahl . | |
| 5,346,560 | 9/1994 | Mournet et al. . | |
| 5,389,161 | 2/1995 | Wawra et al. . | |
| 5,514,226 | 5/1996 | Tenat | 148/217 |
| 5,518,605 | 5/1996 | Tenat | 205/148 |

FOREIGN PATENT DOCUMENTS

| | | |
|---|---|---|
| 0 497 663 | 8/1992 | European Pat. Off. . |
| 0 637 637 | 2/1995 | European Pat. Off. . |
| 0 638 661 | 2/1995 | European Pat. Off. . |
| 971798 | 1/1951 | France . |
| 2 672 059 | 7/1992 | France . |
| 39 33 053 | 5/1990 | Germany . |
| 1 504 917 | 3/1978 | United Kingdom . |

*Primary Examiner*—Scott Kastler
*Attorney, Agent, or Firm*—Young & Thompson

[57] ABSTRACT

In a method of increasing the wear resistance and the corrosion resistance of opposed bearing surfaces of parts subjected to reciprocal friction, in particular when the product of the pressure distributed over the bearing surfaces by the relative speed of the latter exceeds 0.4 MPa.m/s, thermochemical diffusion of nitrogen is effected by nitriding or nitrocarburizing in a molten salt bath at a temperature of 570° C.±15° C. followed by an oxidizing or phosphating surface chemical reaction providing resistance to wet corrosion. The nitriding or nitrocarburizing molten salt bath is made up of alkaline carbonates and cyanates and further contains sulfur-containing substances in the following percentages by weight:

$30\% < CNO^- < 45\%$ $15\% < CO_3^{2-} < 25\%$ $15\% < Na^+ < 25\%$ $20\% < K^+ < 30\%$ $1\% < Li^+ < 6\%$ $1\ ppm < S^{2-} < 100\ ppm$ The time for which parts are immersed in the bath is between 15 minutes and 45 minutes.

10 Claims, No Drawings

METHOD OF TREATING FERROUS SURFACES SUBJECTED TO HIGH FRICTION STRAINS

BACKGROUND OF THE INVENTION

1. Field of the Invention

The present invention concerns a method of increasing the wear and corrosion resistance of ferrous surfaces subjected to intense reciprocal friction.

To be more specific, the invention concerns the treatment of opposed ferrous metal bearing surfaces subjected to intense reciprocal friction, especially if the product of the pressure distributed over the bearing surfaces by the relative sliding speed of the latter exceeds 0.4 MPa.m/s.

2. Description of the Prior Art

Some parts, such as washers, chasers, tools (wrenches, screwdrivers, pliers), lock mechanisms, knurling tools, pins, clips, chain links, etc., are subjected to high strains, especially pressure strains, and can be greatly deformed, for example, bending during mounting and flexing in operation. They must also have good corrosion resistance. Many of these parts are also thin. Methods of treating ferrous metal parts to increase their friction and corrosion resistance properties at one and the same time have already been described, in particular in FR-A-2 672 059, U.S. Pat. No. 5,346,560 and U.S. Pat. No. 5,389,161.

FR-A-2 672 059 describes a method of treating ferrous metal parts to improve their friction and corrosion resistance properties involving nitriding and then oxidizing the parts, which are then coated with a polymer varnish. In one preferred embodiment the nitriding and oxidation are carried out in molten salt baths, the nitriding being carried out in a bath of molten salts based on alkaline cyanates and carbonates and the oxidation being carried out in a bath of molten salts based on alkali metal oxygenated salts, hydroxides, nitrates and carbonates. The nitriding bath advantageously further contains sulfur-containing substances.

U.S. Pat. No. 5,346,560 describes a comparable technology, except that nitriding/oxidation is followed by impregnation with a hydrophobic wax having a high molecular weight.

U.S. Pat. No. 5,389,161 describes nitriding the parts in a bath of sulfur-containing salts based on alkaline carbonates and cyanates, followed by phosphating.

The methods mentioned hereinabove are very effective and are increasingly used in industrial practice. They do have a limitation, however, which is that their effectiveness is significantly reduced if the operating conditions of the parts become very severe, i.e. if the product of the pressure distributed over the rubbing bearing surfaces by the relative sliding speed of the latter exceeds a particular critical threshold, typically in the order of 0.4 MPa.m/s to 0.5 MPa.m/s.

One object of the present invention is to remedy this drawback.

The present invention meets this object by proposing a treatment method for simultaneously improving the wear resistance and the corrosion resistance of ferrous metal surfaces subjected to severe reciprocal friction whose effectiveness remains substantially constant when the parts are very highly strained.

The method of the invention utilizes thermochemical diffusion of nitrogen by nitriding or nitrocarburizing in a molten salt bath followed by oxidizing or phosphating in a molten salt bath. It is characterized by a rigorous selection, specifically arrived at to achieve the stated object, in particular of a set of conditions concerning the thermochemical diffusion of nitrogen, including the concentrations of the various constituents of the molten salt bath and the treatment time.

SUMMARY OF THE INVENTION

Thus the present invention provides a method of increasing the wear resistance and the corrosion resistance of opposed bearing surfaces of parts subjected to reciprocal friction, in particular when the product of the pressure distributed over the bearing surfaces by the relative speed of the latter exceeds 0.4 MPa.m/s, said method being suitable for ferrous metal parts made of iron, additional metallic elements and carbon, with a minimum concentration by weight of 2.5% of additional metal elements or 0.45% by weight of carbon, wherein thermochemical diffusion of nitrogen to harden the bearing surfaces is effected by nitriding or nitrocarburizing in a molten salt bath at a temperature of 570° C.±15° C. followed by a reaction providing resistance to wet corrosion, and:

(i) the nitriding or nitrocarburizing molten salt bath is made up of alkaline carbonates and cyanates and further contains sulfur-containing substances in the following percentages by weight:
$30\% < CNO^- < 45\%$
$15\% < CO_3^{2-} < 25\%$
$15\% < Na^+ < 25\%$
$20\% < K^+ < 30\%$
$1\% < Li^+ < 6\%$
$1\ ppm < S^{2-} < 100\ ppm$ (ii) the time for which said parts are immersed in said nitriding or nitrocarburizing molten salt bath is between 15 minutes and 45 minutes; and (iii) the reaction providing resistance to wet corrosion is a chemical surface reaction selected from the group comprising oxidizing reactions and phosphating reactions.

The method applies to ferrous metal parts made of iron, additional metal elements, in particular Cr, Mo, V, Al, and carbon, with a minimum concentration by weight of 2.5% additional metal elements or 0.45% carbon.

All of these conditions, namely the composition of the nitriding or nitrocarburizing bath, the time of immersion of the parts to be treated in the bath, and the composition of the parts to be treated, must be complied with if the stated object is to be achieved, as explained hereinafter, in particular in the examples.

Table I below shows, for the nitriding nitrogen thermochemical diffusion step, the concentrations of the various constituents of the bath and the treatment time in accordance with the prior art (FR-A-2 672 059, U.S. Pat No. 5,346,560 and U.S. Pat No. 5,389,161) and in accordance with the present invention.

TABLE I

| Method of | Nitriding Bath Composition: Alkaline Carbonates and Cyanates (% by weight) $CNO^-$ | $CO_3^{2-}$ | $Na^+$ | $K^{30}$ | $Li^{30}$ | Sulfur compounds (ppm) $S^{2-}$ | Treatment Time (min) |
|---|---|---|---|---|---|---|---|
| FR-A-2672059 | 35–65 | 1–25 | 25–42.6 | 42.6–62.5 | 11.3–17.1 | 10–10000 A | NS |
| US-A-5,346,560 | 35–65 | 1–25 | 25–42.6 | 42.6–62.5 | 11.3–17.1 | A, NS | NS |
| US-A-5,389,161 | NS | NS | NS | NS | NS | 10, N | 90 ± 15 |
| Present Invention | 30–45 | 15–25 | 15–25 | 20–30 | 1–6 | 1–100, N | 15–45 |

A: advantageous
N: necessary
NS: not specified

In accordance with the present invention, the thermochemical diffusion step, effected under the specific conditions stated hereinabove, is followed by a chemical reaction causing the formation on the surface of substances adapted to resist wet corrosion; this chemical reaction is either an oxidizing reaction or a phosphating reaction.

In accordance with the present invention, said oxidizing reaction is carried out in a molten salt bath made up of alkaline hydroxides, nitrates and carbonates, together with a powerful oxidizing agent, i.e. an agent having a normal oxidation-reduction potential relative to the reference electrode less than or equal to −1 volt, for example alkaline bichromate, at a temperature between 350° C. and 550° C., and with an immersion time of the parts to be treated in said bath between 10 minutes and 30 minutes, and the composition of said molten salt bath, in terms of percentages by weight, is as follows:

$9\% < CO_3^{2-} < 17\%$ $25\% < NO_3^- < 30\%$ $15\% < OH^- < 20\%$ powerful oxidizing anion (e.g. bichromate)<1%.

Table II below indicates the composition of the oxidizing bath in accordance with the present invention and in accordance with the prior art (FR-A-2 672 059, U.S. Pat. No. 5,346,560 and U.S. Pat. No. 5,389,161).

EP 637 637 describes a method of nitriding ferrous metal parts in which the parts are treated by immersion for an appropriate time in a bath of molten salts essentially comprising alkali metal carbonates and cyanates and containing a sulfur-containing substance, wherein, during their immersion in the bath, the parts are raised to a positive electrical potential relative to a counter-electrode dipping into the bath such that a high current flows through the bath from the parts to the

TABLE II

| Method of | Composition of the oxidizing bath (% by weight) |
|---|---|
| FR-A-2 672 059 | alkaline carbonates + nitrates: between 85% and 99.5%<br>alkaline oxygenated salt + hydroxides: remainder to 100% |
| US-A-5,346,560 | oxidizing alkaline salts, nature and concentration unspecified |
| Present invention | $9\% < CO_3^{2-} < 17\%$<br>$25\% < NO_3^- < 30\%$<br>$15\% < OH^- < 20\%$<br>powerful oxidizing anion < 1% |

counter-electrode. According to EP 637 637, the treatment time can be from 10 minutes to 150 minutes, the temperature can be between 450° C. and 650° C. and the liquid active part of the bath can contain 30% to 40% CNO-anion, 15% to 25% $CO_3^{2-}$ anion, 20% to 30% $K^+$ cation, 15% to 25% $Na^+$ cation, 0.5% to 5% $Li^+$ cation, 0.5% to 5% $Li^+$ cation and between 1 ppm and 6 ppm of $S^{2-}$.

According to EP 637 637 the current densities used on the parts to be treated are between 300 $A/m^2$ and 800 $A/m^2$, preferably between 450 $A/m^2$ and 500 $Am^2$.

Note that even if the composition of the nitriding bath of EP 637 637 is similar to that of the nitriding bath of the present invention, the two methods are fundamentally different. Firstly, in contradistinction to EP 637 637, no current flows through the molten salt baths of the present invention. Secondly, the method in accordance with the present invention is in two steps, the thermochemical diffusion step being followed by an oxidizing or phosphating step, whereas EP 637 637 is critical of multi-step methods and claims a single-step method.

In accordance with the present invention, the nitrogen thermochemical diffusion step by nitriding or nitrocarburizing mentioned above may be preceded by pre-nitriding carried out in a bath having a similar composition to that used for the nitriding or the nitrocarburizing.

The pre-nitriding is carried out at a temperature from 520° C. to 550° C. for a period from 60 minutes to 180 minutes and is followed by cooling to a temperature of approximately 370° C. to 400° C. (i.e. cooling by approximately 150° C.).

The embodiment of the invention including the pre-nitriding treatment reconciles a high hardness of the treated part in a thin surface zone with deep diffusion of sufficient nitrogen for the treated part to have better fatigue resistance that obtained without the pre-nitriding treatment.

The thermochemical nitrogen diffusion step after pre-nitriding is advantageously of reduced duration, between 15 minutes and 30 minutes.

When the above operations have been carried out, it is particularly advantageous to complete the treatment by application to the surface of a product adapted both to reduce the tendency to seizing and to facilitate accommodation (i.e. the ability of the parts to conform to each other during rubbing contact).

The anti-seizing product can be a metal having a low Young's modulus such as Ag, Sn, Pb, Cd or a so-called "anti-friction" alloy such as Sn/Pb, Zn/Ni, etc. deposited in the form of a thin layer.

It can instead be a polymer coating, a wax impregnation, a so-called "soluble" oil or a varnish, possibly charged with a solid lubricant such as graphite, molybdenum disulfide, PTFE.

In all cases the thickness of the layer of said product must be sufficient to have a significant effect, but not too thick to cause excessive creep due to the high pressure on the bearing surfaces. We have found that a thickness of the anti-seizing product layer between 2 μm and 15 μm is sufficient.

For randomly lubricated bearing surfaces, the surface of the parts is advantageously sculpted, for example grooved of knurled, to provide traps for wear debris and a reserve of lubricant.

We have analyzed metallographic sections in an attempt to explain the mechanisms by which the method of the present invention acts. Accordingly, we have carried out microhardness measurements on sectioned test pieces of steel with various compositions treated in various ways. The results, described in detail in the following examples, show that good tribological performance is obtained at very high P×V (pressure×relative velocity) values if:

- the thickness of the surface layer of nitrides is between 10 μm and 20 μm, of which substantially the half in contact with the substrate is very compact while the other (surface) half is slightly porous;
- the hardness of the supporting steel is high at the surface and then falls off very quickly to reach the core hardness in a few tens of micrometers.

Good results typically correspond to nitriding (or nitrocarburizing) carried out under conditions such that the equivalent hardened depth, measured from the hardened steel surface under an external layer of nitrides (defined as the depth at which the increase of hardness brought about by nitriding is 37% of the increase at the surface) is between a minimum of 20 μm and a maximum of 120 μm, the nil depth hardness extrapolated from the hardnesses at staggered depths being at least three times the core hardness.

With the specified current densities, the method of EP 637 637 mentioned above does not achieve the same nitriding (or nitrocarburizing) effect as the present invention, in terms of morphology of the surface nitride layer and the supporting steel hardness gradient referred to hereinabove.

Although theoretical considerations must not be regarded as implying any limitation on the scope of the invention, the following explanation could account for the particular tribological properties imparted to very highly strained steel parts by the method of the present invention.

The fact that the pressure distributed over the bearing surfaces is high implies that localized pressures are also very high: hence the need for high mechanical specifications, in particular hardness, at the surface and in the underlying layer.

The mechanical parts that the invention concerns are for the most part subject to misalignment and consequent edge bearing effects that amplify excess straining phenomen. This leads to the requirement for relatively high accommodation of the steel. However, in most cases, this property is incompatible with the high hardness mentioned above, since very hard layers are only slightly ductile, often fragile and subject to scaling. The highly negative hardness gradient that characterizes parts treated in accordance with the invention represents an acceptable compromise, since the very hard surface layer is thin: the properties of thin layers are known to be very different from those of solid materials.

It is also probable that the method of the invention yields residual compression stresses in the surface layers that are favorable in the intended applications.

Finally, note that the energy dissipated by friction, which is directly related to the P×V product and to the coefficient of friction, can be high: not only is the P×V product high (>0.4 MPa.m/s), but the coefficient of friction is also high for most intended applications since the lubrication conditions are random, the parts even being required to function dry (without lubrication) in some cases. Good surface anti-seizing properties are therefore required; the presence of substances having solid lubrication properties can therefore only be favorable.

DETAILED DESCRIPTION OF EXAMPLES OF THE INVENTION

The invention will now be described in more detail with reference to the following non-limiting examples in which, unless indicated otherwise, all proportions and percentages are by weight.

EXAMPLE 1

Batches of pin and disk type test pieces of steel with the following composition: C: 0.3%, Cr: 13%, the remainder being iron, heat treated by quenching followed by annealing, were nitrided under the following conditions:

composition of the molten salt bath:

$CNO^-$=37%

$CO_3^{2-}$=18%

$Na^+$=17%

$K^+$24%

$Li^+$=4%

$S^{2-}$=6ppm bath temperature: 565° C.;

immersion time of parts in the bath: 30 minutes.

On removal from the nitriding bath, the test pieces were phosphated in accordance with the teaching of U.S. Pat. No. 5,389,161 (Example 1) and then coated with soluble oil.

Friction tests were then carried out on a laboratory simulator, with a pin rubbing on a disk with a reciprocating rectilinear movement under the following conditions:

travel: 8 mm, distributed pressure: 70 MPa, sliding speed: 0.006 m/s,

P×V=0.42 MPa.m/s, surroundings: dry in air, test duration: 8 hours.

The test result was characterized by the cumulative wear of the pin and the disk and by the surface states of the rubbing bearing surfaces.

The results obtained were as follows:

cumulative wear of pin+disk: 0.1 mm, state of surfaces at end of test: polished.

With regard to the corrosion resistance of the treated parts, the results obtained were compatible with those stated in U.S. Pat. No. 5,389,161, i.e. several hundred hours resistance to salt spray.

Microhardness measurements on sectioned treated test pieces gave the following results:

core hardness (HV100): 320, nil depth hardness (HV100): 1 300, equivalent hardened depth: 30 μm.

Note that the equivalent hardened depth, measured from the hardened steel surface under an external layer of nitrides, was between 20 μm and 120 μm and that the nil depth hardness extrapolated from the hardness at staggered depths was at least three times the core hardness, which conforms to the favorable configuration previously mentioned in the description.

EXAMPLE 2 (Comparative)

Cumulative pin and disk wear tests were carried out on test pieces of the same composition as Example 1 but without any treatment, i.e. without any conditioning of the surface. The tests were ended prematurely (i.e. after a few minutes, at most 30 minutes); seizing was observed, with significant deterioration of the surface state and high wear (1 mm to 2 mm).

EXAMPLE 3

Test pieces with the same composition as in Example 1 were treated as in Example 1, except that only the disk was treated.

Performance was degraded compared to that with both parts treated; it remained acceptable, however:

cumulative wear of pin+disk: 0.3 mm;

surface state at end of test: slight scoring.

EXAMPLE 4

Batches of pin and disk type test pieces of steel having the following composition: C: 0.08%, Cr: 17%, the rest being iron, heat treated by quenching followed by annealing, were nitrided and phosphated and then tested under the same conditions as in Example 1.

The results were comparable with those of Example 1 in terms of friction performance and resistance to corrosion (salt spray).

Microhardness measurements on sectioned treated test pieces gave the following results:

core hardness (HV100): 350, nil depth hardness (HV100): 1 350, equivalent hardened depth: 25 μm.

Note that the equivalent hardened depth, measured from the hardened steel surface under an external layer of nitrides, was between 20 μm and 120 μm and that the nil depth hardness extrapolated from the hardness at staggered depths was at least three times the core hardness, which conforms to the favorable configuration previously mentioned in the description.

EXAMPLE 5

Batches of pin and disk type test pieces of steel having the following composition: C: 0.4%, Cr: 5%, Mo: 1.3%, V: 0.4%, the remainder being iron, heat treated by quenching followed by annealing, were nitrided under the same conditions as in Example 1.

All the parts were then phosphated, followed by impregnation with soluble oil as described in U.S. Pat. No. 5,389,161 (Example 1).

The batches of treated test pieces were tested as in Example 1. The cumulative wear and surface state results are summarized in Table III below.

Microhardness measurements on sectioned treated test pieces gave the following results:

core hardness (HV100): 400, nil depth hardness (HV100): 1 400, equivalent hardened depth: 40 μm.

Note that the equivalent hardened depth, measured from the hardened steel surface under an external layer of nitrides, was between 20 μm and 120 μm and that the nil depth hardness extrapolated from the hardness at staggered depths was at least three times the core hardness, which conforms to the favorable configuration previously mentioned in the description.

EXAMPLE 6 (Comparative)

Batches of test pieces identical to those of Example 5 were nitrided as in Example 5, except that the treatment time was increased to four hours. They were then phosphated as in Example 5.

The batches of treated test pieces were tested as in Example 1. The cumulative wear and surface state results are indicated in Table III below.

Microhardness measurements on sectioned treated test pieces gave the following results:

core hardness (HV100): 400, nil depth hardness (HV100): 1 000, equivalent hardened depth: 170 μm.

Note that the equivalent hardened depth, measured from the hardened steel surface under an external layer of nitrides, was not between 20 μm and 120 μm and that the nil hardness depth extrapolated from the hardnesses at staggered depths was not at least three times the core hardness. Thus these test pieces did not have all of the metallurgical characteristics conforming to the favorable configuration mentioned previously in the description.

EXAMPLE 7 (Comparative)

Batches of test pieces identical to those of Example 5 were nitrided under the following conditions:

composition of the molten salt bath:

$CNO^-$=55%

$CO_3^{2-}$=10%

$Na^+$=20%

$K^+$=13%

$Li^+$=2%

$S^{2-}$=1 000 ppm bath temperature: 565° C.;

immersion time of parts in the bath: 90 minutes.

They were then phosphated as in Example 5. The batches of treated test pieces were tested as in Example 1. The cumulative wear and surface state results are indicated in Table III below.

Microhardness measurements on sectioned treated test pieces gave the following results:

core hardness (HV100): 400, nil depth hardness (HV100): 1 150, equivalent hardened depth: 140 μm.

As in Comparative Example 6 above, these test pieces did not have all of the metallurgical characteristics conforming to the favorable configuration mentioned previously in the description.

TABLE III

| Example | Cumulative Wear (mm) | Surface State |
|---|---|---|
| 5 | 0.09 | polished |
| 6 | 0.8 | scaling |
| 7 | 0.6 | scoring |

The results obtained in Example 5 confirm the high level of performance that can be expected of parts treated in accordance with the present invention.

The results obtained in Comparative Examples 6 and 7 show that performance deteriorates when the claimed specifications of the present invention are not complied with.

EXAMPLE 8

Batches of pin and disk type test pieces of steel having the following composition: C: 0.4%, Cr: 5%, Mo: 1.3%, V: 0.4%, the remainder being iron, heat treated by quenching followed by annealing, were subjected to pre-nitriding by immersion for two hours in a nitriding bath having the same composition as in Example 1 at a temperature of 530° C. The parts were then cooled to 380° C. The parts were then nitrided in a nitriding bath having the same composition as in Example 1 at 570° C. for 30 minutes.

The treated parts were then tested as in Example 1. The friction test results obtained were as follows:

cumulative wear: 0.11 mm, surface states: good.

EXAMPLE 9

Batches of pin and disk type test pieces of steel having the following composition: C: 0.3%, Cr: 13%, the remainder being iron, heat treated by quenching followed by annealing, were nitrided as in Example 1.

On removal from the nitriding bath they were, in accordance with the invention, immersed for 15 minutes in an oxidizing bath at 450° C., the bath having the following composition by weight of anions:

$CO_3^{2-}$=15%

$NO_3^-$=27%

$OH^-$=18%

$Cr_2O_7^{2-}$=0.25%

The parts were then impregnated with polyethylene wax as described in U.S. Pat. No. 5,346,560 (Example 1).

The results of friction tests carried out under the same conditions as in Example 1 above were as follows:

cumulative wear of pin+disk: 0.12 mm, surface states at end of test: good.

Microhardness measurements on sectioned treated test pieces gave the following results:

core hardness (HV100): 350, nil depth hardness (HV100): 1 350, equivalent hardened depth: 25 μm.

EXAMPLE 10

Test pieces identical to those of Example 9 were treated as in Example 9 except that the polyethylene wax treatment was replaced by coating with fluoro-ethylene-propylene (FEP) to a thickness of 10 μm, in accordance with the teaching of FR-A-2 672 059.

The results for exactly the same disk and pin treatment are indicated in Table IV below.

EXAMPLE 11

Test pieces identical to those of Example 9 were treated as in the Example 9 except that the polyethylene wax treatment was replaced by coating with a layer of polymer varnish charged with PTFE in accordance with the teaching of FR-A-672 059.

The results for exactly the same disk and pin treatment are indicated in Table IV below.

EXAMPLE 12

Test pieces identical to those of Example 9 were treated as in Example 9 except that the polyethylene wax treatment was replaced by coating with a 8 μm thick layer of polymer varnish charged with $MoS_2$.

The results for exactly the same disk and pin treatment are indicated in table IV below.

TABLE IV

| Example | Cumulative Wear (mm) | Surface State |
|---|---|---|
| 10 | 0.1 | very good |
| 11 | 0.9 | very good |
| 12 | 0.14 | good |

EXAMPLE 13

Batches of shaft and bearing shell test pieces in steel having the following composition: C: 0.4%, Cr: 5%, Mo: 1.3%, V: 0.4%, the remainder being iron, were treated as in Example 12 above.

The treated test pieces were then tested by means of oscillating bearing tests under the following conditions:

shaft diameter: 35 mm, shaft/bearing clearance: 0.1 mm, alternating rotation, frequency: 0.65 Hz, cycle: 15 seconds on, 60 seconds off, distributed pressure: 50 MPa, P×V: 0.4 MPa.m/s, surroundings: air, lubrication: by wiping parts before assembly with an oily rag, followed by addition of further lubricant.

The test result was characterized by the time after which a temperature sensor in the bearing in line with the contact area and 2 mm from the surface indicated a rapid rise in temperature.

Metallographic sections of the test pieces confirmed that the hardness gradient conformed to the favorable configuration mentioned in the description and in Example 1 above.

When both parts were treated the duration of the test before a rapid rise in the temperature of the bearing was 320 hours.

When only the bearing shell was treated, the duration of the test before the rapid rise in temperature of the bearing was 270 hours.

This example confirms that it is preferable to treat both parts of the rubbing pair, but that performance is nevertheless acceptable when only one part is treated.

By way of comparison, tests carried out with shafts and bearing shells that had not been treated led to seizing after less than 30 minutes.

EXAMPLE 14 (Comparative)

Test pieces identical to those of Example 13 above were treated and tested as in Example 13 except that the composition of the nitriding bath was as follows (not in accordance with the invention):

$CNO^-$=55%

$CO_3^{2-}$=10%

$Na^+$=20%

$K^+$=13%

$Li^+$=2%

$S^{2-}$=1 000 ppm

The rapid rise in temperature occurred after 45 hours.

EXAMPLE 15 (Comparative)

Test pieces identical to those of Example 13 above were treated and tested as in Example 13 except that the nitriding time was four hours (not in accordance with the invention).

The rapid rise in temperature occurred after 40 hours.

Microhardness measurements on sectioned treated test pieces gave the following results:

core hardness (HV100): 250, nil depth hardness (HV100): 450, equivalent hardened depth: 350 μm.

The above measurements show that these test pieces did not have all of the metallurgical characteristics conforming to the favorable configuration mentioned previously in the description.

EXAMPLE 16 (Comparative)

Batches of shaft and bearing shell test pieces of steel having the following composition: C: 0.2%, Mo: 1.5%, V: 0.5%, the remainder being iron, i.e. a composition not in accordance with the invention, were treated and tested as in Example 13 above.

The rapid rise in temperature occurred after 40 hours.

Microhardness measurements on sectioned treated test pieces gave the following results:

core hardness (HV100): 280, nil depth hardness (HV100): 500, equivalent hardened depth: 400 μm.

The above measurements show that these test pieces did not have all of the metallurgical characteristics conforming to the favorable configuration mentioned previously in the description. The tribological performance was relatively poor.

EXAMPLE 17 (Comparative)

Batches of shaft and bearing shell test pieces in non-alloy steel having the following composition: C: 0.38%, the remaining being iron, quenched and then annealed, i.e. having a composition not in accordance with the invention, were treated and tested as in Example 13 above.

The rapid rise in temperature occurred after 50 hours.

Microhardness measurements on sectioned treated test pieces gave the following results:

core hardness (HV100): 300, nil depth hardness (HV100): 500, equivalent hardened depth: 400 μm.

The above measurements show that these test pieces did not have all of the metallurgical characteristics conforming to the favorable configuration previously mentioned in the description. The tribological performance was relatively poor.

What is claimed is:

1. Method of increasing the wear resistance and the corrosion resistance of opposed bearing surfaces of parts subjected to severe reciprocal friction, when the product of the pressure distributed over the bearing surfaces by the relative speed of the latter exceeds 0.4 MPa.m/s, said method being suitable for ferrous metal parts made of iron, additional metallic elements and carbon, with a minimum concentration by weight of 2.5% of additional metal elements or 0.45% by weight of carbon, said method comprising: effecting thermochemical diffusion of nitrogen to harden the bearing surfaces by nitriding or nitrocarburizing in a molten salt bath at a temperature of 570° C.±15° C. followed by performing a reaction providing resistance to wet corrosion, and wherein:

(i) said nitriding or nitrocarburizing molten salt bath is made up of alkaline carbonates and cyanates and further contains sulfur-containing substances in the following percentages by weight:

$30\% < CNO < 45\%$ $15\% < CO_3^{2-} < 25\%$ $15\% < [NA^+]\ Na^+ < 25\%$ $20\% < K^+ < 30\%$ $1\% < Li^+ < 6\%$ $1\ ppm < S^{2-} < 100\ ppm$ (ii) the time for which said parts are immersed in said nitriding or nitrocarburizing molten salt bath is between 15 minutes and 45 minutes, to thereby obtain a nitride surface layer of the parts ranging between 10 and 20 μm, and an equivalent hardened depth, measured from a hardened steel surface under said nitride surface layer, ranging between 20 and 120 μm; and (iii) said reaction providing resistance to wet corrosion is a chemical surface reaction selected from the group comprising oxidizing reactions and phosphating reactions.

2. Method according to claim 1 wherein said surface chemical reaction providing resistance to wet corrosion is an oxidizing reaction carried out in a molten salt bath made up of alkaline hydroxides, nitrates and carbonates, together with a powerful oxidizing agent having a normal oxidation-reduction potential relative to the reference electrode less than or equal to −1 volt, at a temperature between 350° C. and 550° C., and with an immersion time of the parts to be treated in said bath between 10 minutes and 30 minutes, and the composition of said molten salt bath, in terms of percentages by weight, is as follows:

$9\% < CO_3^{2-} < 17\%$ $25\% < NO_3^- < 30\%$ $15\% < OH^- < 20\%$ powerful oxidizing anion <1%.

3. Method according to claim 1 wherein said surface chemical reaction providing resistance to wet corrosion is a phosphating reaction.

4. Method according to claim 1 wherein pre-nitriding is carried out before thermochemical diffusion of nitrogen in a bath having a similar composition to said nitriding bath at a temperature of 520° C. to 550° C. for between 60 minutes and 180 minutes followed by cooling by approximately 150° C.

5. Method according to claim 4 wherein the duration of said thermochemical nitrogen diffusion step following pre-nitriding is from 15 minutes to 30 minutes.

6. Method according to claim 1, for randomly lubricated opposed bearing surfaces, wherein said thermochemical diffusion and chemical surface reaction operations are followed by application to the surface of a thickness between 2 μm and 15 μm of a product adapted to reduce the tendency to seizing and to facilitate accommodation.

7. Method according to claim 6 wherein said product adapted to reduce said tendency to seizing and to facilitate accommodation is one of a) a metal having a low Young's modulus selected from the group consisting of Sn, Ag, Pb, Cd, and b) a metal alloy selected from the group consisting of Sn/Pb, Zn/Ni, deposited in a thin layer.

8. Method according to claim 6 wherein said product adapted to reduce said tendency to seizing and to facilitate accommodation is a polymer coating, comprised of one of a varnish and an impregnation wax.

9. Method according to claim 8 wherein said polymer varnish contains a solid lubricant selected from the group consisting of graphite, molybdenum disulfide and PTFE.

10. Method according to claim 1, for randomly lubricated bearing surfaces, wherein, before said thermochemical diffusion of nitrogen, chemical surface reaction and surface application of a product adapted to reduce said tendency to seizing and to facilitate accommodation, the surfaces of said parts are sculpted, knurled or grooved.

* * * * *